US006270849B1

(12) United States Patent
Popoola et al.

(10) Patent No.: US 6,270,849 B1
(45) Date of Patent: Aug. 7, 2001

(54) METHOD OF MANUFACTURING A METAL AND POLYMERIC COMPOSITE ARTICLE

(75) Inventors: Oludele Olusegun Popoola, Novi; Larry Van Reatherford, Clarkston; Ronald Paul Cooper, Eastpointe; Robert Corbly McCune, Southfield, all of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/370,298

(22) Filed: Aug. 9, 1999

(51) Int. Cl.[7] ..... B05D 1/02; B05D 1/36; B22D 23/00; B28B 11/00

(52) U.S. Cl. ..... 427/404; 427/447; 427/455; 427/456; 427/409; 427/422; 427/427; 164/46; 164/465; 29/888.061; 29/888.44; 29/890.122; 29/527.6; 264/309

(58) Field of Search ..... 427/447, 448, 427/455, 456, 404, 409, 419.1, 422, 426, 427; 164/46, 465; 29/888.06, 888.061, 888.44, 890.122, 527.3, 527.4, 527.5, 527.6; 264/255, 309

(56) References Cited

U.S. PATENT DOCUMENTS 4,963,404 * 10/1990 Jenkins ..... 428/34.7
5,021,259 6/1991 Singelyn .
5,074,256 12/1991 Saito .
5,283,121 * 2/1994 Bordner ..... 427/381
5,434,210 7/1995 Rangaswamy et al. .
5,464,486 11/1995 Rao .
5,635,002 * 6/1997 Oikawa et al. ..... 156/196
5,660,934 8/1997 Longo .
5,753,313 * 5/1998 Tsai ..... 427/449
5,766,690 6/1998 Derby et al. .
5,829,404 11/1998 Mori et al. .
5,837,048 11/1998 Kelley .

FOREIGN PATENT DOCUMENTS 8-183136 * 7/1996 (JP) .

* cited by examiner

*Primary Examiner*—Shrive P. Beck
*Assistant Examiner*—Michael Barr
(74) *Attorney, Agent, or Firm*—Damian Porcari; William J. Coughlin

(57) ABSTRACT

A method of manufacturing a metal and polymeric composite article by the following steps. Droplets of spray deposited metal and spray deposited polymeric material are combined to form an article having the polymeric material interspersed within the metal. A carrier or form that shaped to receive the metal and polymeric layers is provided. The carrier may be made either stationary or movable. Layers of spray deposited metal and spray deposited polymeric material are applied atop the carrier. The spray deposited metal is between 90 and 95 percent by volume of the article. The polymeric layers do not completely cover the metal layers. Succeeding spray deposited metal layers contact bond to previous metal layers. The polymeric material between imbedded between the interconnected metal layers.

14 Claims, 5 Drawing Sheets

METHOD OF MANUFACTURING A METAL AND POLYMERIC COMPOSITE ARTICLE

BACKGROUND OF THE INVENTION

1. Field of the Invention

The present invention relates to a method of manufacturing a metal/polymer composite article. More particularly, the present invention relates to a method of forming a metal/polymer composite article by spraying molten metal and polymeric materials to form articles composed of metal and polymer admixtures.

2. Description of the Related Art

There are several motivations to produce material article that incorporates both metallic and polymeric phases. The metal provides strength and durability while the polymeric material reduces the weight of the article and provides for lower frictional properties or allows for chemical interaction to occur through the article. While many possible applications exist for metal/polymeric composite materials, their manufacture has been difficult and expensive. Generally, the temperatures needed to melt metals of technological interest will vaporize most polymers.

Materials that have improved wear resistance, self lubricating, and or thermal insulating properties have been prepared by thermal spray processes. These materials have generally been applied atop a metal article as a thin coating. For example, U.S. Pat. No. 5,837,048, teaches a plasma spray coating of polymeric cellulose ether with a metal or ceramic powder. Between 1 and 10% by weight of the polymeric material is combined with the metal or ceramic and applied as a plasma spray feedstock. The polymeric, metal and ceramic materials are blended together combined and sprayed using a spray gun. The invention describes the complexities of spraying the mixture through a single spray gun. The spray temperatures for spraying metal and polymeric materials are different and the metal and polymeric materials tend to separate.

U.S. Pat. Nos. 5,434,210, 5,766,690 and 5,464,486 also teach methods of combining friction-reducing materials with metals and ceramics to produce powders that can be formed into abradable seals using thermal spray. Again, the metal and friction reducing material are premixed and applied using a single thermal spray gun. The mixture forms a relatively thin coating that is applied to a metal article. However, thermally spraying premixed metal/polymer or ceramic/polymer powders often produce unacceptable end results because the optimal conditions required (temperatures, type of projecting gas, voltage, current) metals, ceramics and polymers are significantly different. Consequently, the thermal spray parameters that optimize the microstructures and properties of one phase often produce undesirable chemistry and properties of the other.

Another use of a metal/polymeric article is as a separator for an electrical or chemical article. U.S. Pat. No. 5,021,259, teaches a method of applying a thermoplastic coating onto a porous metal surface by thermally spraying the thermoplastic polymer. The porous metal and coating are then heated to fuse the thermoplastic polymer coating into the porous metal. The metal supports the polymer and forms a protective covering for the metal. This patent additionally teaches a method of infiltrating a polymeric material into the surface of a metallic substrate. The polymer is applied as relatively thin coating atop a metal substrate. The metal substrate must first be formed to have the desired porosity network. The polymer coating must be melted to cause the coating to flow into the pores. Because of the relatively low viscosity of polymeric materials, the polymer only penetrates the area nearest to the surface of solid metals.

A relatively new material combines polymeric and metal materials into a single particle that can he used as a thermal spray powder feedstock. U.S. Pat. No. 5,660,934 teaches methods for manufacturing clad plastic powder particles suitable for thermal spray. These powder particles, consisting of a plastic core surrounded by ceramic or metal particles, can be thermal sprayed because the outer ceramic and metal particles protect the inner polymeric material for the high thermal spray temperature. These onerous ceramic or metal encapsulated polymeric particles are often used as a small fraction of an overall thermal spray feedstock material.

The salient feature of all of the above is that they teach various methodologies of improving the surface wear and corrosion properties of metallic articles using metal/polymer or ceramic/polymer composite coatings. In all cases the metallic substrate provides the bulk properties while the coating provides desired surface characteristics. These articles always require dual bulk and surface manufacturing steps and their useful life usually terminates once the surface coatings are removed. The cited references do not teach any methodology of making a complete article that incorporates intimate mixtures of metal and polymeric materials in its bulk. Additionally they do not teach the use of co-deposition techniques, using multiple and different thermal spray guns to form solid articles containing polymeric and metallic admixtures.

Traditional valve seats for sealing around poppet valves in internal combustion engines maybe made of sintered powdered metal compacts or alloy castings. Casting and sintering processes often require temperatures in excess of 1000° C. and limit the compositions available for use as valve seat inserts. Desirable solid lubricating materials such as $MoS_2$ and BN cannot be easily incorporated into the valve seat material because they either decompose, sublime, or fail to provide wetting at the melting or sintering temperatures of most metals. Traditional valve seats have not incorporated polymeric material because the processing temperatures needed to incorporate the polymeric material into the valve seats exceed the decomposition, boiling or degradation point of most polymeric materials.

The need for self lubricating valve seats is extremely important for compressed or liquid pressurized natural gas (CNG or LPG) fueled engines. Gasoline fuels contain additives that provide some degree of lubrication to the valves; especially the intake valves. Natural gas does not provide any lubrication to the valves. They run virtually dry. Consequently, traditional valve seats do not provide the required engine durability. Harder valve seat inserts particularly those containing significant amount of cobalt, molybdenum, chromium and lead have been used with natural gas engines but these components are much more costly than traditional valve seats inserts. Liquid sodium filled ultra light valves have also been used to reduce the heat buildup and the spring load between the valve and valve seat. These products are also expensive and can be problematic in case of unanticipated valve failure.

The present invention overcomes all of the above limitations and enables the manufacturing of a low cost metal/polymeric article that has polymeric material throughout the bulk thus providing the article with better friction and wear properties and extended life. The present invention also produces an article in a single step without the need for separate bulk and surface processing. The process incorporates simultaneous metal and polymer processing methodology to form metal/polymer composite article having required bulk and surface properties.

SUMMARY OF THE INVENTION

The present invention is directed to a method of manufacturing a metal and polymeric composite article by the following steps. A spray deposited metal alloy and a spray deposited polymeric material are combined to form an article having the polymeric material interspersed within the metal. A carrier or mandrel shaped to receive the metal and polymeric layers is provided. The carrier may be either stationary or movable. Spray deposited metal and spray deposited polymeric material are applied atop the carrier using coordinated multiple thermal spray guns. The metals and the polymers are deposited using different guns with optimized parameters for each material and deposition technique. The spray deposited article comprises between seventy five and ninety percent by volume of the article. The polymeric and metallic materials are intimately mixed within the bulk article. Adequate cooling is provided during deposition to prevent the degradation of the polymeric material and guarantee the appropriate bulk density.

A wide variety of metals, and polymeric materials are suitable for use with the present method including iron, nickel, copper and titanium based alloys as well as thermoplastic and thermoset epoxies such as polycarbonates, ketones and Teflon. The metal is usually supplied in the form of a wire or powder feed stock while the polymer is in powder or pellet form. The metal can be sprayed using conventional arc, plasma, or combustion processes while the polymer is deposited using flame or plasma techniques.

The method produces a composite article having the polymeric material phases encased or surrounded by the metallic ones. The polymeric material may be deposited substantially uniformly throughout the article or concentrated in areas of greatest need. The concentration and distribution of the metal and polymeric material can be controlled by the spraying process as will be more fully described below and in the attached drawings.

These and other desired objects of the present invention will become more apparent in the course of the following detailed description and appended claims. The invention may best be understood with reference to the accompanying drawings wherein illustrative embodiments are shown.

DETAILED DESCRIPTION OF THE PREFERRED EMBODIMENT

Figure 1:
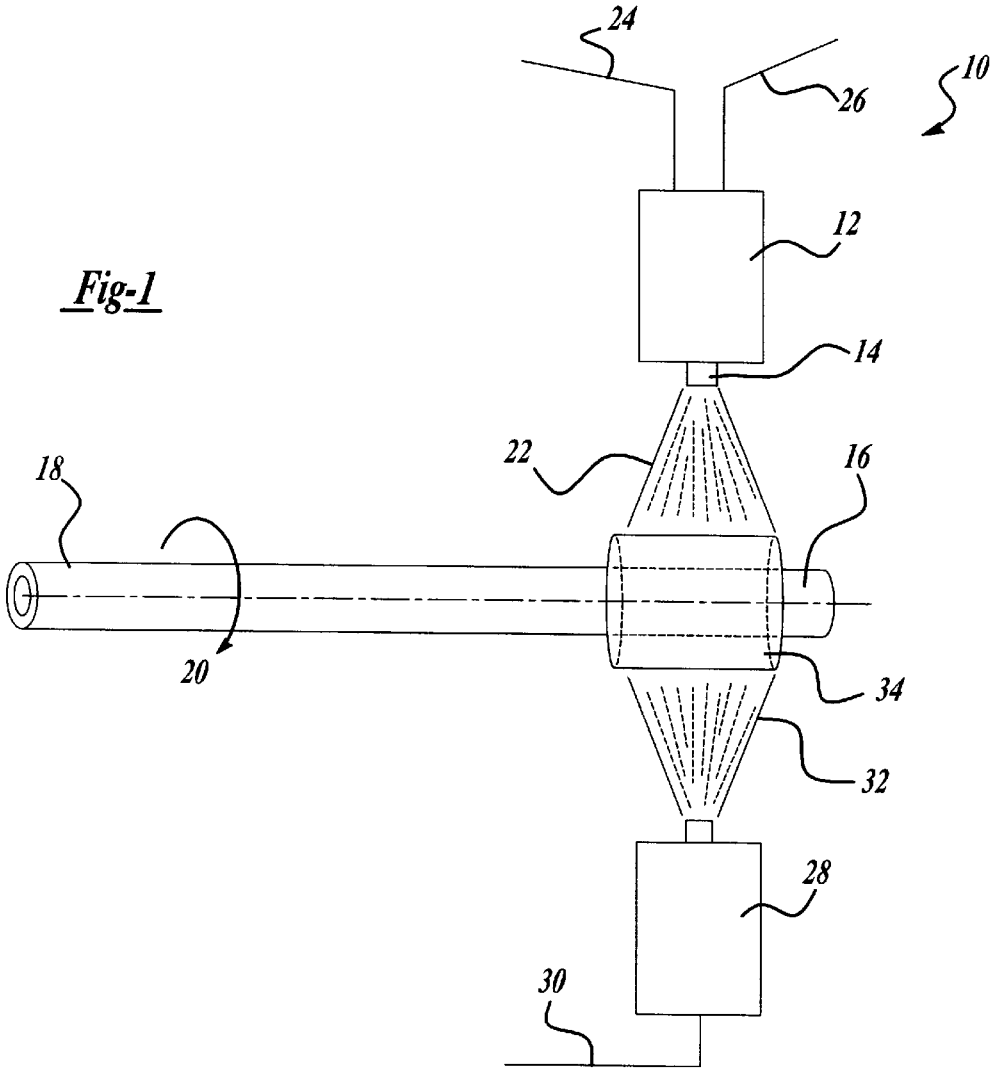
FIG. 1 is a schematic illustration of one apparatus used for carrying out the thermal spray step of this invention making hollow ring-shaped articles.

The invention as illustrated in FIGS. 1–4 teaches a method of manufacturing automotive valve seat inserts (valve seats). The invention will also be described as a method of manufacturing a flat panel, however other components may also be manufactured using the same or similar process, technique and equipment, and are included within the invention described herein.

The following items are a word list of the items described in the drawings and are reproduced to aid in understanding the invention;

10. Thermal spray apparatus
12. Thermal spray gun
14. Spray head
16. Target mandrel surface
18. Mandrel
20. Direction of rotation
22. Spray droplets from gun
24. Feed supply
26. Feed supply
28. Thermal spray gun
30. Polymeric material feed stock
32. Spray droplets from gun
34. Cylindrical metal and polymeric composite article
36. Section
38. Apparatus
40,42. Metal spray guns
44. Polymeric spray gun
46. Spray
48. Carrier
50. Direction
52. Polymeric spray
53. Spray
54. Edge
56. Direction Illustrated in FIG. 1 is a thermal spray setup 10 depositing layers of molten metal and molten plastic. The thermal spray gun 12 comprises a two-wire arc feedstock (however thermal spray gun 12 may be wire arc, powder plasma, or any other of the high velocity methods such as high velocity oxy-fuel (HVOF), detonation gun or cold gas-dynamic spraying).

The thermal spray gun 12 has a spray head 14 placed between 6–12 inches from the target mandrel surface 16. A mandrel 18 rotates in the direction marked 20. As the mandrel 18 rotates, the thermal spray gun 12 emits a spray 22 of molten droplets that deposit a layer of bulk material on the mandrel surface 16. The deposition rate varies with the composition of the bulk material being deposited. However, deposition rates of between 2–10 pounds per hour provide adequate build time. The process for depositing bulk material on a rotating mandrel is illustrated in commonly assigned U.S. patent application Ser. No. 08/999,247, entitled "METHOD OF MAKING SPRAY FORMED INSERTS", filed Dec. 29, 1997, now U.S. Pat. No. 5,983,495 and incorporated herein by reference. This patent application teaches a method of making valve seats by applying a bulk material to a rotating hollow mandrel.

The selection of the chemistry for the wire or feed supply 24, 26 to the gun 12, to carry out thermal spraying, is dependent upon the article to be formed by the thermal spray process. When manufacturing valve seats, feed supply 24 is selected from a nickel-based alloy having a composition of 58% nickel, 4% niobium, 10% molybdenum, 23% chromium, and 5% iron. The feed stock 26 is selected from a carbon steel having a composition of 1% carbon, 1.6–2% chromium, 1.6–1.9% manganese, and the balance iron. The two wire arc thermal spray gun 12 is operated at between 30–33 volts, 200–300 amps, using between 60–100 psi air as the propelling gas. The process forms molten metal spray droplets having a particle size of in the range of 10–100 $\mu$m in diameter.

The thermal spray gun 28 applies molten polymeric material simultaneously with the thermal spray gun 12. Polymeric material is selected to provide continuous lubrication of the valve seat during engine operation. The glass transition temperature $T_g$, degree of crystallinity, impact fatigue strength, alkane solubility, re-crystallization temperature, high melting point, and high shear viscosity are all important properties a polymeric material must possess in order to be used in high temperature applications such as in valve seats inserts.

A thermoplastic polyethylene ethyl ketone (PEEK) was selected as the polymeric material feedstock 30. PEEK was selected because of its high temperature chemical stability, high melting point, and complete insolubility in alkane. The material used has an average particle size of 40–60 Mm, 30–40% crystallinity, a $T_g$ of 289° F., a melting temperature of 649° F., a heat distortion temperature of 599° F., and a continuous use temperature of 500° F. Other polymeric materials such as fluoropolymers, thermoplastic polycarbonates and elastomers, and polyimides can be used.

The PEEK feed stock 30 is sprayed in a propane flame using air or argon as the propelling gas. The gun 28 produces a polymeric spray droplets 32. The guns 12 and 28 are positioned at 15–30 cm and 5–15 cm respectively from the mandrel surface 16 during deposition. The gun 12 was turned on first and allowed to deposit about 1 mm thick material before gun 28 is turned on. Due to the rotation of mandrel 18, the sprayed layer is an intimate mixture of solidified polymeric and metallic droplets. Various metal to polymer proportions can be produced by adjusting the parameters of spray guns 12 and 28 respectively. The percentage by volume of metal is between 75 and 90%. More preferably, the percentage of metal is between 90 and 95%. The metal percentage by weight is between 90 and 98%, more preferably between 93 and 95%.

Figure 2:
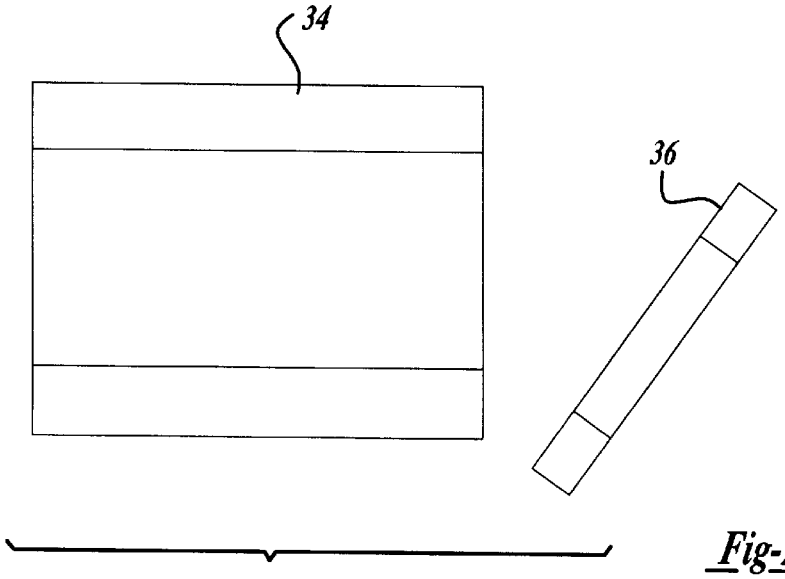
FIG. 2 is a cross-sectional view of a hollow ring-shaped article made from the method of FIG. 1.

A build-up of intermixed metal and polymer sprays from droplets 22 and 32 forms until the metal/polymeric composite article 34 is formed. The article 34 is r-moved from the mandrel 20, machined to specified dimensions and cut into thin sections 36 as illustrated in FIG. 2. Alternatively, the mandrel 20 is machined away prior to sectioning. In another practice of the invention, the flame was turned off in gun 30 during the polymer spray onto the surface 16 simultaneously with the metal deposition. The heat from the molten metal spray heated the polymer spray sufficiently to soften the polymer and form the metal/polymer admixture.

Figure 3A:
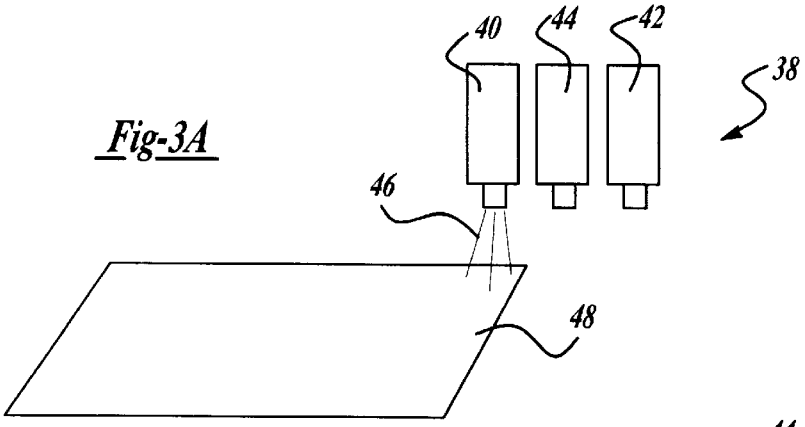
FIGS. 3A–E are schematic illustrations of an alternative apparatus used for carrying out the thermal spray step of the invention making flat articles.
Figure 3B:
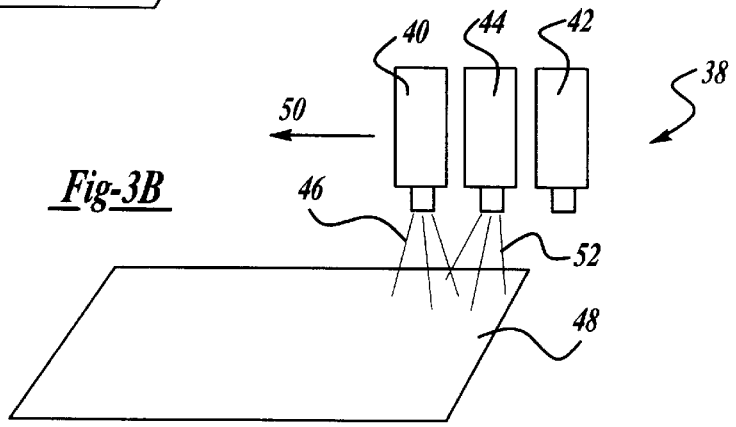
Figure 3C:
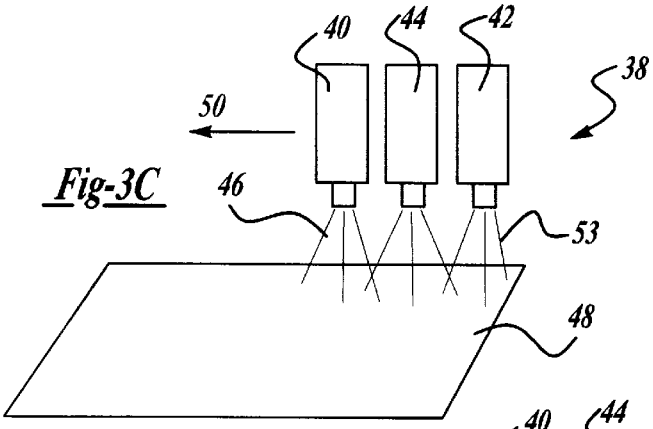
Figure 3D:
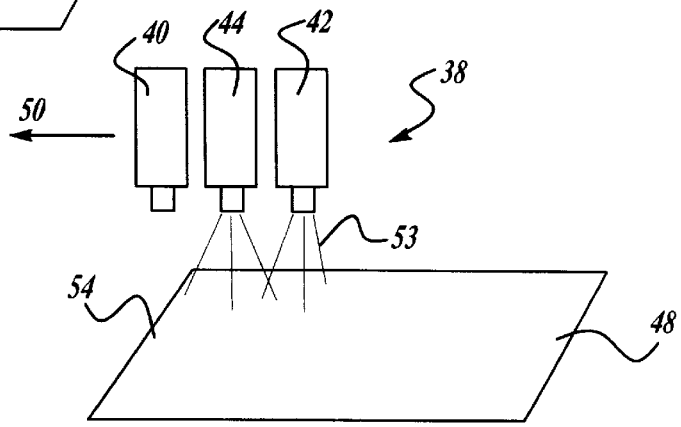
Figure 3E:
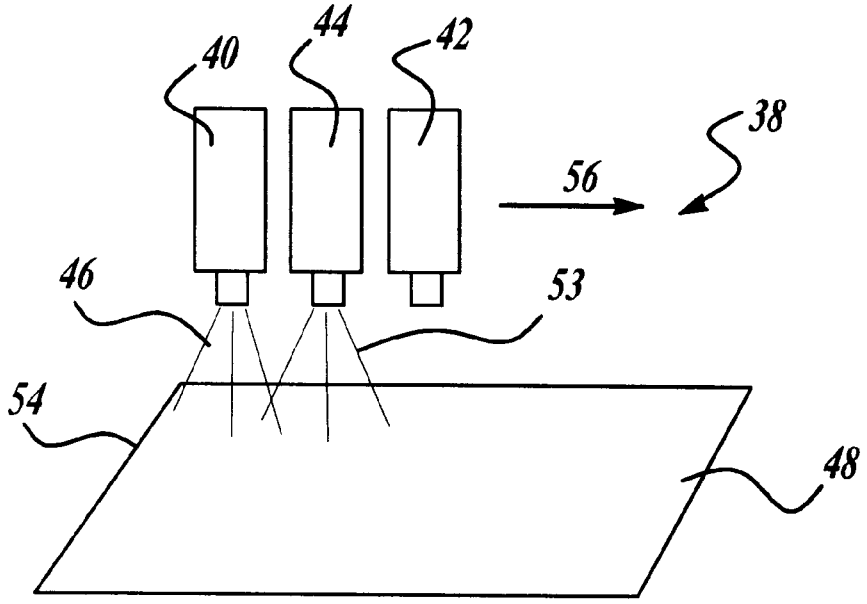

Illustrated in FIGS. 3*a*–3*d* is the method of making flat panels having layers or admixtures of independently sprayed metal and polymeric material. The thermal spray apparatus 38 includes a bank of metal spray guns 40, 42 and polymeric spray gun 44. The guns can be independently controlled to deposit alternating or mixed layers on carrier 48. The metal spray gun 40 applies a molten metal spray 46 onto a carrier 48. The carrier 48 serves as a target to receive the molten metal and polymeric spray. The bank of spray guns 40, 42, 44 are moved in the direction 50 and the spray gun 44 applies a polymeric spray 52 on top of the previously applied metal spray layer as shown in FIG. 3*b*. The spray guns 40, 42, 44 are moved further in the direction 50 as illustrated in FIG. 3*c*. The spray gun 42 applies a molten metal spray 53 atop the previously applied polymeric layer. The molten metal spray 53 may be the same or different from the metal spray 46. The spray guns 40, 42, 44 are moved in direction 50 as shown in FIG. 3*d*. The spray gun 40 ceases applying the thermal spray when it reaches the edge 54 of the carrier 48. Likewise, the spray gun 44, 42 also cease spraying when they reach the edge 54. The spray guns 40, 42, 44 are then cycled back in the direction 56 and the spray gun 44 applies polymeric spray 52 and then the spray gun 40 applies a metal spray 46 as illustrated in FIG. 3*e*.

In this way, metal and polymeric layers may be continuously applied to the carrier 48 without having a build-up of either metal or polymeric material along the edge 54 or over-spraying beyond the perimeter of the carrier 48.

Figure 4A:
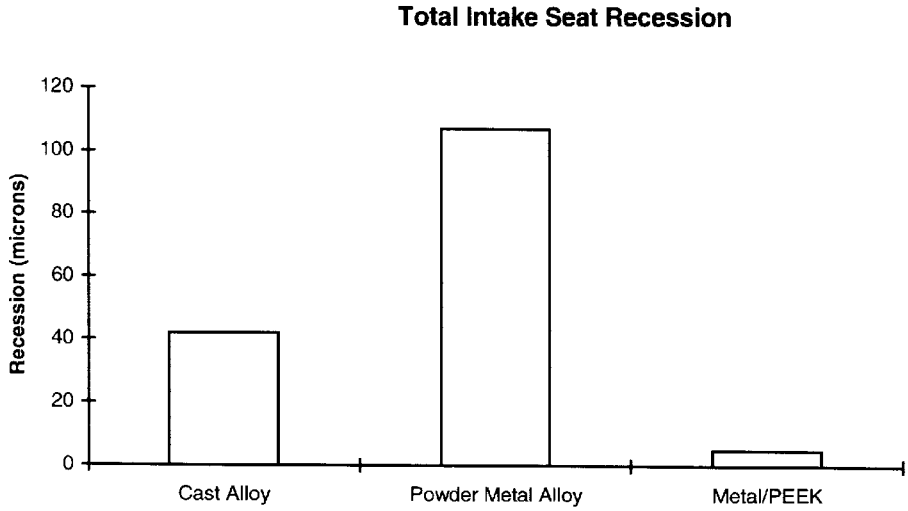
FIGS. 4A and 4B are a graphs comparing the performance of an automotive valve seat insert made using this invention with inserts made from cast and powder metallurgy.
Figure 4B:
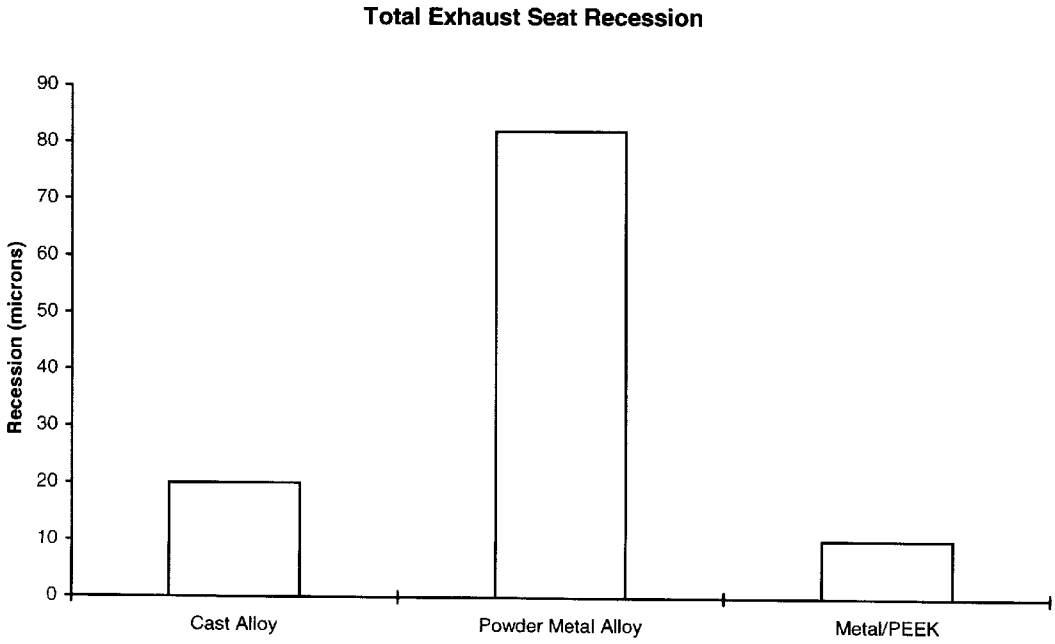

The invention was found to be especially well suited for the manufacture of internal combustion engine valve seats. The valve seats were manufactured using the forgoing process. An elongated tube was formed around the mandrel and then cut into thin sections which were subsequently machined into valve seats. The valve seats included the PEEK polymer throughout the seat. This construction enabled the manufacture of valve seats that could be used with conventional valves in CNG engines. The inclusion of the PEEK polymer permitted a permanent lubrication of the valve/valve seat interface during engine operation. Illustrated in FIG. 4B is the performance evaluation of valve seat inserts made using this invention, cast inserts as well as powder metallurgy ones. The dynamometer testing was done on production 2.0 liter modular, in-line 4 cylinder, 4 valve engine under full load, wide open throttle at 5800 rpm. Given that only 75 mm was the maximum allowable recession on this engine, only the valve seat inserts manufactured using this invention meets adequate performance criteria, particularly in intake applications.

The comparative performance of valve seats made from the metal/PEEK material and those made from conventional Powder Metal and Cast Alloys. Valve seats made from metal/PEEK substantially better wear resistance (measured as recessions) than either the Powder Metal Alloy or Cast Alloy valve seats. The improved performance is believed to be the result of incorporating the PEEK throughout the body of the valve seat and not merely as a coating.

Figure 5:
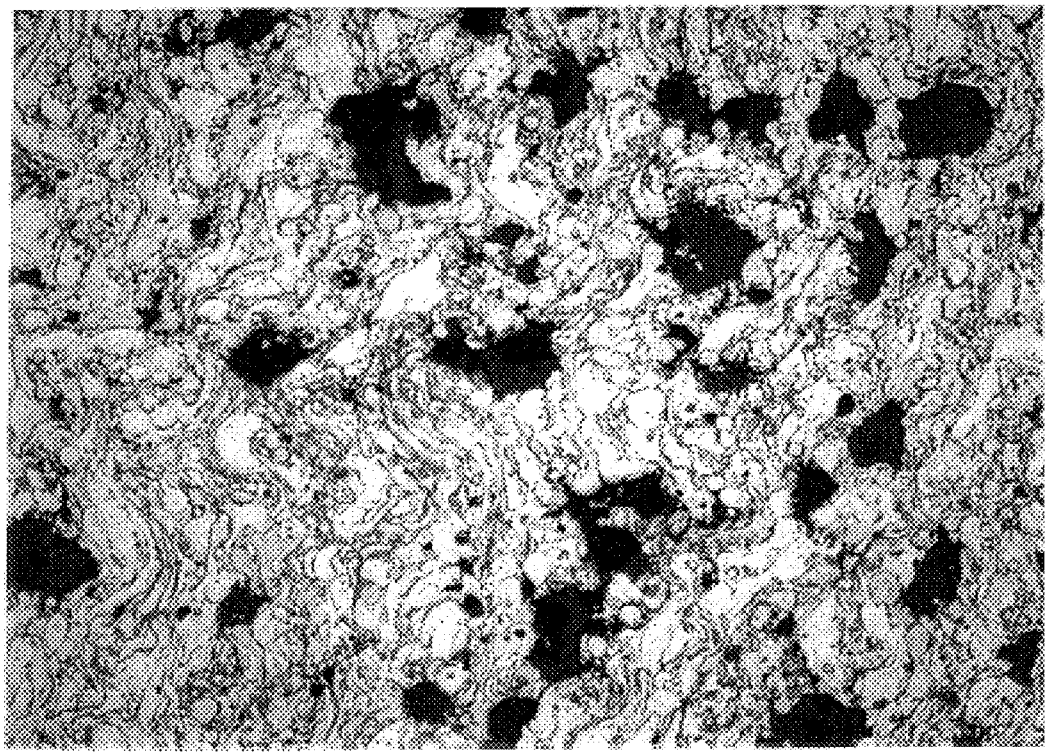
FIG. 5 is a photomicrograph of the article made by the present invention.

Illustrated in FIG. 5 is a photomicrograph of the metal and polymeric composite material made according to the present invention. The polymeric material appears as the dark spots. The polymeric material is distributed evenly throughout the material.

The invention has been described as a method of manufacturing an engine valve seat and a flat sheet. While the best modes for carrying out the invention have been described in detail, those familiar with the art to which this invention relates will recognize various alternative designs and embodiments for practicing the invention as defined by the following claims.

What is claimed:

1. A method of manufacturing a metal and polymeric composite article comprising the steps of:

applying a spray deposited metal layer on to a carrier; and applying a spray deposited polymeric material onto said carrier, to form said article; and removing said article from said carrier.

2. The method of claim 1, wherein said carrier is a flat panel and said article is planer.

3. The method of claim 1, wherein said spray deposited polymer material partially covers said spray deposited metal.

4. The method of claim 3, further comprising spraying a second metal layer atop said deposited polymer material and wherein spray deposited metal layer and said second metal layer are interconnected to form a metal and polymeric composite having polymeric material trapped between interconnected areas of solidified metal.

5. The method of claim 1, wherein the percentage volume of said composite article is between 90 and 95%.

6. The method of claim 1, wherein the percentage by weight of said composite article is between 90 and 98% metal.

7. The method of claim 1, wherein said carrier is a cylindrical tube and said article is ring-shaped.

8. A method of manufacturing a metal and polymeric composite valve seat insert comprising the steps of:

applying a spray deposited metal layer on to a cylindrical tube-shaped carrier;

applying a spray deposited polymeric material onto said carrier, to form said article; and removing said article from said carrier.

9. A method of manufacturing a metal and polymeric composite article comprising the steps of:

applying a first layer of spray deposited metal atop a carrier;

applying a second layer of spray deposited polymeric material atop said first layer; and applying a third layer of spray deposited metal atop said second layer, said third layer encasing said second layer and forming said composite article.

10. The method of claim 9, wherein said first application step includes forming said first layer to have interstices and causing said second layer to penetrate into said interstices.

11. The method of claim 10, wherein the volume of said interstices is between 2 and 10% of the volume of said first spray deposited metal layer.

12. The method of claim 11, wherein said second layer only partially covers said first layer and portions of said first layer are exposed surfaces.

13. The method of claim 12, wherein said third layer contacts and bonds to said exposed surfaces and encases said second layer between said first and third layers.

14. A method of manufacturing an internal combustion valve seat insert comprising the steps of:

applying a spray deposited metal layer on to a tubular carrier;

applying a spray deposited polymeric material onto said carrier, said polymer material partially covering said metal layer; and applying additional spray deposited metal layers atop said polymer material, said additional spray deposited metal layers interconnecting with said spray deposited metal layer to form a metal and polymeric composite having polymeric material trapped between interconnected areas of solidified metal.

* * * * *